US005732430A

United States Patent [19]

Beitz et al.

[11] Patent Number: 5,732,430

[45] Date of Patent: Mar. 31, 1998

[54] DEVICE FOR ASSEMBLING AND LAYING TRACK SUPPORT AND LAUNCHING SUPPORT SECTIONS INTO A BRIDGE SUPPORT STRUCTURE

[75] Inventors: Uwe Beitz, Dienheim; Lutz Hanselmann, Mainz; Hans-J. Kärcher, Karben; Alfons Scholz, Bischofsheim; Eberhard Sust, Mainz; Jan Ghering, Gustavsburg, all of Germany

[73] Assignee: MAN Gutehoffnungshütte Aktiengesellschaft, Oberhausen, Germany

[21] Appl. No.: 636,640

[22] Filed: Apr. 23, 1996

[30] Foreign Application Priority Data

Mar. 16, 1996 [DE] Germany ..... 196 10 440.8

[51] Int. Cl.[6] ..... E01D 15/127

[52] U.S. Cl. ..... 14/2.5; 414/550

[58] Field of Search ..... 14/2.5, 78, 77.1; 414/10, 550, 718; 212/301

[56] References Cited

U.S. PATENT DOCUMENTS

| | | | |
|---|---|---|---|
| 4,288,881 | 9/1981 | Mahncke et al. | 14/2.5 |
| 4,400,133 | 8/1983 | Booker | 414/718 |
| 4,972,538 | 11/1990 | Parramore | 14/2.5 |

FOREIGN PATENT DOCUMENTS

| | | | |
|---|---|---|---|
| 2753259 | 6/1978 | Germany | 212/301 |
| 29 29 201 A1 | 2/1981 | Germany . | |
| 36 28 273 | 3/1988 | Germany . | |
| 3737680 | 5/1989 | Germany | 14/2.5 |
| 31 06 140 C2 | 2/1990 | Germany . | |
| 38 42 373 A1 | 6/1990 | Germany . | |
| 40 08 769 | 9/1991 | Germany . | |
| 41 26 250 A1 | 2/1993 | Germany . | |
| 41 27 106 C2 | 12/1994 | Germany . | |
| 40 09 354 C2 | 11/1995 | Germany . | |

*Primary Examiner*—James Lisehora
*Attorney, Agent, or Firm*—McGlew and Tuttle

[57] ABSTRACT

A device for assembling and laying track support bridge sections displaceable at right angles to their longitudinal axis, with launching support structures, which are arranged between the track supports and are likewise transversely displaceable, into a bridge support structure. The device includes a base frame with a plurality of telescoping props, base frame being built up on a vehicle. A laying arm is provided pivotable around a horizontal axis at one end of the base frame. A front arm is provided pivotable around a horizontal axis at another end of the base frame. Both the laying arm and the front arm are adjustable by hydraulic cylinders. A displacing device is provided for pushing the bridge sections apart and together. The displacement device includes track support and launching support sections arranged between the front arm and the laying arm on the base frame in a transverse direction in relation to the base frame. The base frame supports both each lower chord of launching support section and each lower chord of track support in a mounting manner. A height-adjustable feed drive is provided for driving the launching support after one of the bridge sections has been pushed apart. The feed drive is arranged on the base frame between the front arm and the laying arm. A front end guide and a laying end guide is provided for positioning one of bridge supports, which is to be fitted in and can be pushed apart. A connection device is provided for establishing a connection between the bridge sections fed in and pushed apart, and bridge sections or bridge sections already present on the device, connection means being arranged in an area of guides. A mount is provided for each of telescoping and pivotable props, each mount for receiving outer lower chords of bridge sections moved apart.

8 Claims, 5 Drawing Sheets

DEVICE FOR ASSEMBLING AND LAYING TRACK SUPPORT AND LAUNCHING SUPPORT SECTIONS INTO A BRIDGE SUPPORT STRUCTURE

FIELD OF THE INVENTION

The present invention pertains to a device for assembling and laying track support sections into a bridge support structure, the support sections being displaceable at right angles to the longitudinal axis with a launching support arranged between the track supports.

BACKGROUND OF THE INVENTION

A bridge support structure is a collapsible track support bridge, which composed of a number of individual bridge sections. A plurality of the sections are arranged one behind the other and form one track, and an equal number form the other track of the bridge support structure. Each section half is arranged such that the overall length of the bridge is located between the tracks of a longitudinal opening interrupted by crossbeams only.

For the user of a collapsible bridge with launching supports arranged between the track supports, the ideal system consists of a minimum number of transport vehicles and the laying vehicle, wherein all vehicles do not exceed the permissible transport width in the loaded state. The assembly and the laying process should take place automatically in order to have to use only a minimum number of persons directly for the laying.

DE 41 27 106 C2 discloses a vehicle with a spreading, coupling and laying device for a prior-art bridge system (DE 41 26 250 A1), comprising a plurality of uniform bridge sections designed as extensible track supports. For stability, this device is mounted on a tracked vehicle and is not suitable for laying track support bridges with launching supports arranged between the track supports, because the extensible device acts on the outer side of the track supports and thus cannot actuate the launching support arranged between the track supports.

DE 40 09 354 C2 discloses a collapsible track support bridge with a launching support arranged between the track supports, which have launching supports extensible in the transverse direction and extensible track supports. The laying process takes place according to FIGS. 1 through 10 of the above-mentioned document.

The individual bridge sections are usually extended only on a prior-art tracking vehicle having a special body, according to DE 38 42 373 A1, and they are then placed on the laying vehicle by means of a crane.

A bridge-laying device with a pivotably articulated jib at the tail of the vehicle has been known from DE 29 29 208 A1. Via an unfavorable leverage, the weight of a bridge section is picked up and held in order to be subsequently coupled with another bridge section, which is already located on the laying device.

A bridge-laying device with a crane for moving to the next laying rail section or bridge section to be coupled has been known from DE 31 06 140 C2. Since this crane is arranged centrally on the vehicle behind the driver's cab, this positioning is suitable only for bridge-laying in which a launching support is first assembled and is pushed over an obstacle and deposited in order to subsequently push the bridge over the obstacle after the assembly.

SUMMARY AND OBJECTS OF THE INVENTION

The primary object of the present invention is to design a laying device such that the requirements imposed by a user in terms of the ideal system mentioned at the introduction are met.

This object is accomplished primarily by the extension of the bridge sections not being carried out first on the tracking vehicles, but on the laying vehicle. Therefore, only a means for moving apart and pushing together is needed, and it is thus possible to use commercially available vehicles without a special body for transporting the bridge sections.

Not only does this measure lead to an advantageous solution to the primary object of the present invention, but a device is also provided, which meets the requirements for an automatic process.

The laying device according to the present invention comprises a base frame connected to a wheel vehicle (truck) with prior-art telescoping and pivotable props, a hydraulically actuated laying arm, a hydraulically actuated front arm with supporting rollers and a feed drive, and, arranged between the front arm and the laying arm, a means for centering and for moving bridge sections apart and for pushing them together.

A corresponding base frame with the above-mentioned bodies may be mounted, in principle, on any suitable, commercially available wheel vehicle. This offers the advantage that not only are the tracking vehicles, with which bridge sections are brought in, commercially available wheel vehicles, but the laying vehicle does not have to be a special vehicle either, so that the fleet of vehicles needed for building bridges from individual bridge sections consists of commercially available vehicles, which do not exceed the transport width specified for road transportation.

Instead of a wheel vehicle as a laying vehicle, it is also possible to use a tracked vehicle.

It is advantageous if not only the two inner lower chords of the track support sections together with the two lower chords of the launching support are mounted in the same plane, but the two outer lower chords of the track supports are also preferably supported in that plane.

If the two outer lower chords of the track support sections, which have already been pushed to the laying arm and/or to the front arm, are also supported in the same above-mentioned plane, the coupling of the sections will always take place without problems.

It was found that disturbances occur as a consequence of the difference in the heights of the two outer lower chords, which is caused by the torsion softness of the ramp section, at the time of the coupling of an inner section with a ramp section if both are supported only in or under the two inner lower chords.

Another advantage of the present invention is that a feed drive is arranged between the front arm and the laying arm in order to feed the first two bridge sections to the laying and front arm after extension.

According to another feature of the present invention, the guide is arranged in the vicinity of the front arm end facing the middle of the device and of the laying arm end for positioning the spreadable bridge section to be fitted in.

According to the present invention, the feed means for extending and pushing together preferably have inner bearing rollers with wheel flanges facing each other, which act on the inside of the launching support lower chords during the extension of a bridge section.

For pushing together a bridge section, vertical guide rollers, which act on the outside of the outer track support lower chords, are arranged according to the present invention next to the outer horizontal bearing rollers. These vertical guide rollers also have the task of centering a bridge section fed in from the top in the transverse direction on the device, and they may optionally be used as a guide during the feeding of a bridge section, especially a ramp section, to the laying or front arm.

In another embodiment of the present invention, it is suggested that two hoists be arranged next to each other in the vicinity of the two telescoping and pivotable props, in the area between the first guide and the laying arm end and between the second guide and the front arm end.

It is thus possible to place a bridge section from a tracking vehicle onto the device according to the present invention, regardless of which side of the device the tracking vehicle is located on.

The hoists are connected to both front sides of the bridge section by means of fastening means, as a result of which only half of the load is transmitted to the hoist. This hoist is used during the disassembly of the bridge to lift off a bridge section in the state of transportation from the device and to place it on the tracking vehicles. If the tracking vehicles have hoists on board, the hoists on the laying vehicle may be eliminated.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
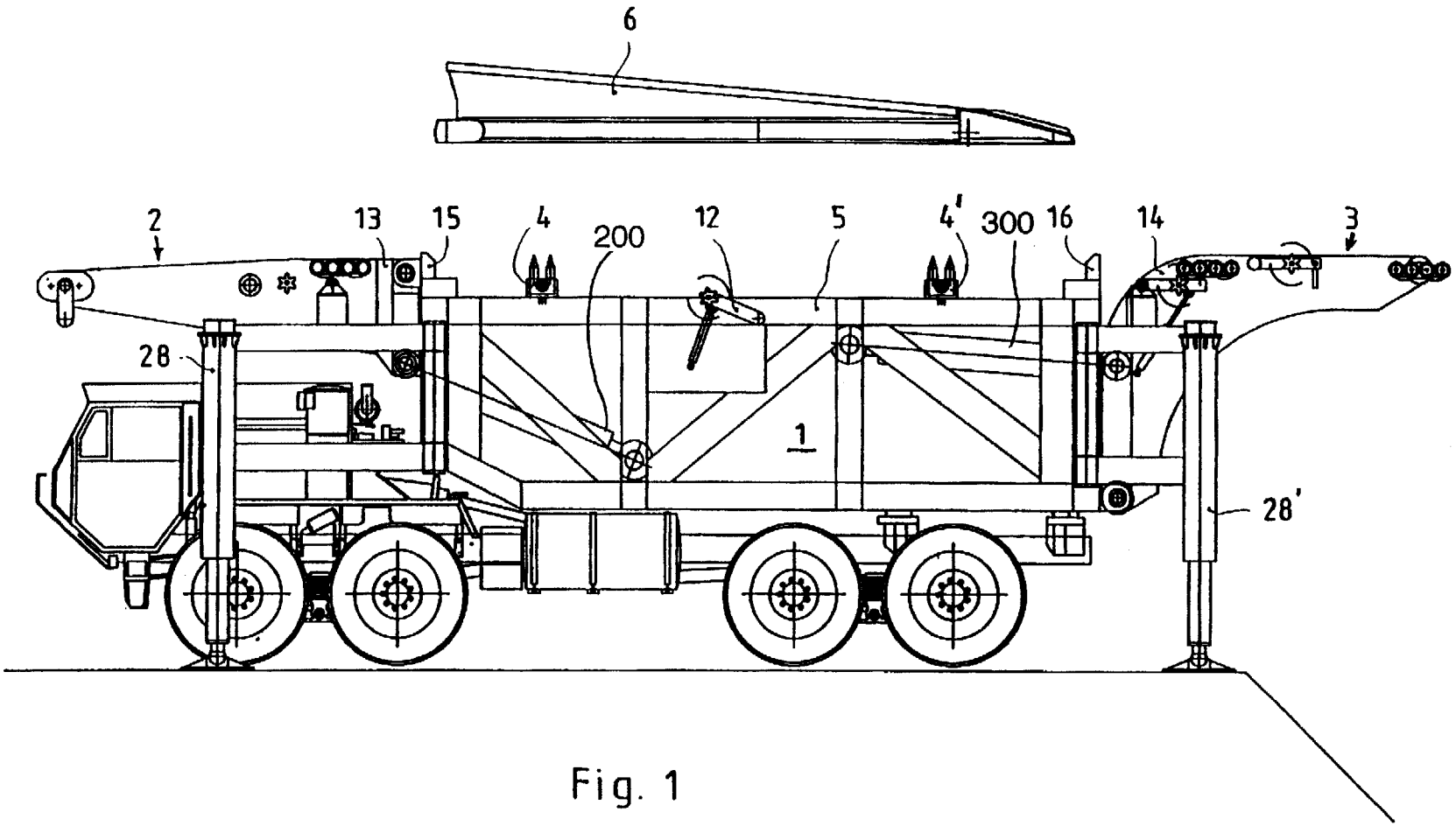
FIG. 1 is a side view of the device on a wheel vehicle.

Referring to the drawings in particular, the invention comprises a device for assembling and laying track support bridge sections 6 and ramp sections 19. The bridge section 6, 19 are arranged at fight angles to a longitudinal axis of the section. Launching support structures 8 are arranged between the track supports and are likewise transversely displaceable into the bridge support structure. The device 1 is built-up on a base frame 5 with a plurality of telescoping props 28, 28'. The device 1 has a laying arm 3 which is pivotable around a horizontal axis. A front arm 2 is provided pivotable around a horizontal axis at the other end of the device 1. The laying arm 3 and the front arm 2 are adjustable by means of hydraulic cylinders 300 and 200, respectively.

FIG. 1 shows a wheel vehicle (truck) with the device 1 and with a first bridge section 6 located above it, which has not yet been deposited.

The telescoping props 28, 28' are extended. The horizontally articulated front arm 2 and the likewise horizontally articulated laying arm 3 are located in the horizontal transportation plane. It can be clearly recognized that two displacing means 4, 4' and a feed drive 12 are arranged between the front arm 2 and the laying arm 3. The guides 15, 16 in the vicinity of the front arm end 13 and of the laying arm end 14 ensure the correct positioning of a bridge section 6.

Figure 2:
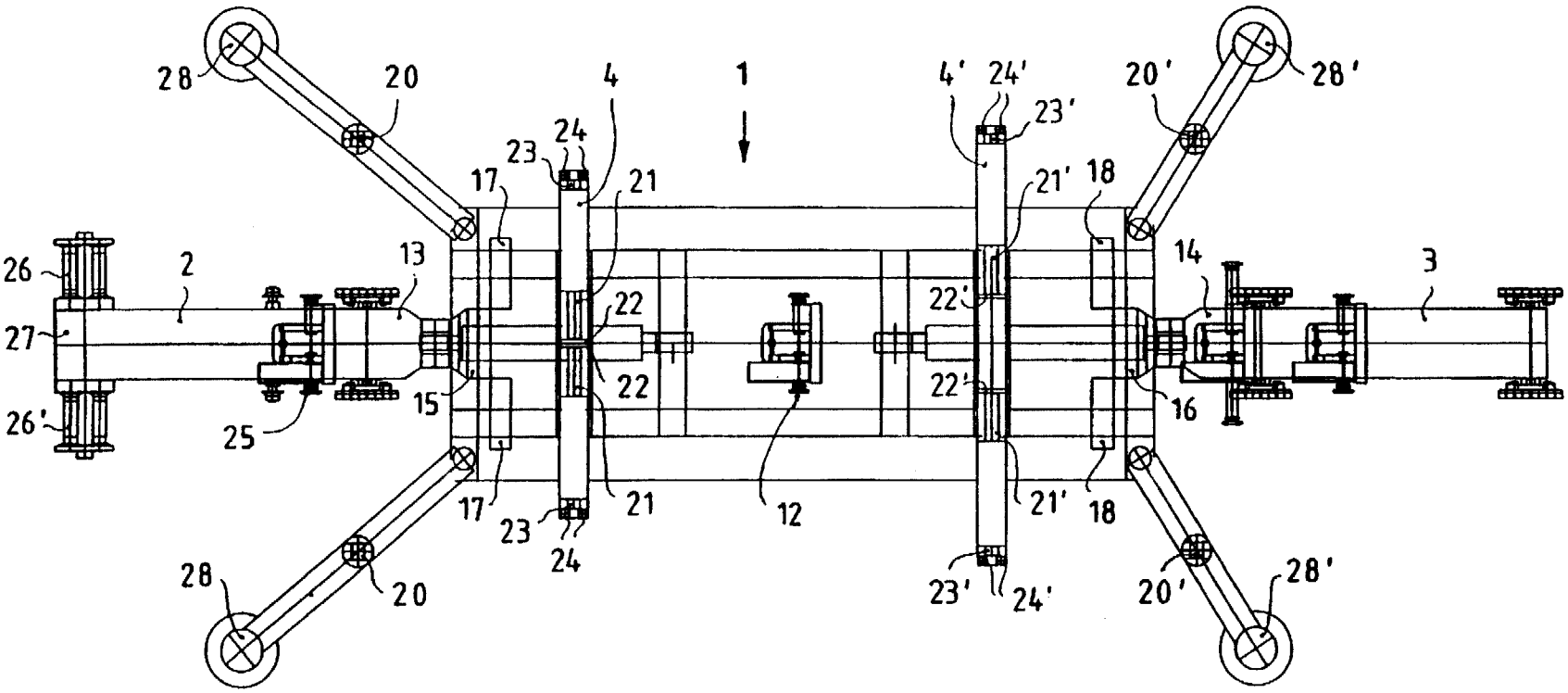
FIG. 2 is a top view of the device without vehicle.

The top view of the device 1 according to FIG. 2 shows how the front props 28 are pivoted out.

The displacing means 4, 4' have horizontal bearing rollers 21, 21' with wheel flanges 22, 22' facing each other. These horizontal bearing rollers 21, 21' are for the lower chords 7, 7' of the launching support 8 and additional horizontal outer bearing rollers 23, 23' are provided for the outer lower chords 10, 10' of the track support 11 with vertical guide rollers 24, 24' arranged next to them It is remarkable that only the displacing means 4' with its bearing rollers 21', 23' is first extended on one side. It can also be recognized that the mounts 20, 20' on the pivotable props 28, 28' are aligned with the bearing rollers 23', because they carry the outer lower chords 10, 10' and are to facilitate the coupling of this lower chord, because the above-mentioned mounts 20, 20', have no difference in height. Support rollers 26, 26' are arranged at the front arm tip 27 to ensure that the lower chords 7, 7' of the launching support 8 and the lower chords 9, 9' of the track support 11 are always in contact during the assembly and the laying process. Connection means 17, 18 for establishing a connection between two bridge sections, not shown, are arranged in the area of the guides 15, 16.

Figure 3:
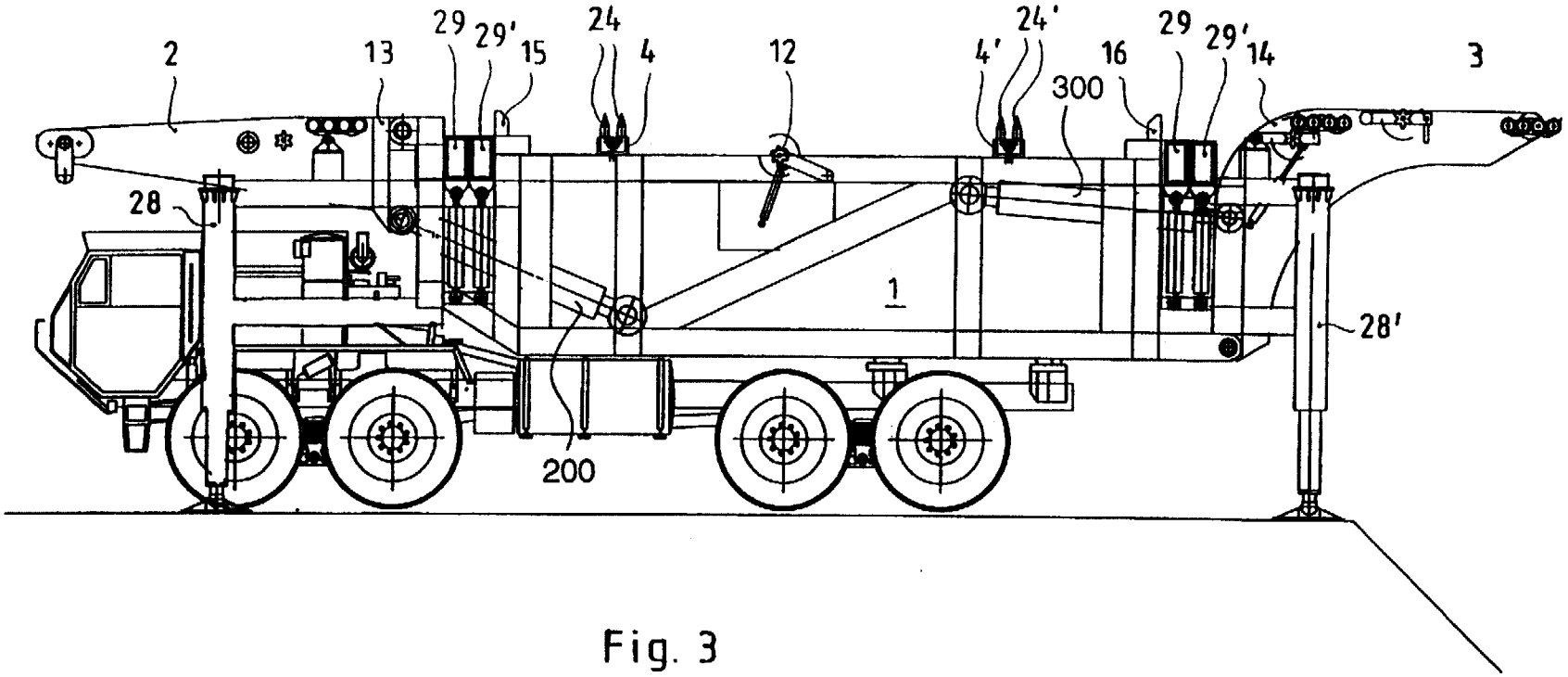
FIG. 3 is a side view of the device with integrated hoist on a wheel vehicle.

FIG. 3 shows a wheel vehicle (truck) with a device 1 with integrated hoist 29, 29'.

The telescoping props 28, 28' are extended. The horizontally articulated front arm 2 and the likewise horizontally articulated laying arm 3 are in the horizontal transportation position.

The two hoists 29, 29' each are arranged next to each other in the vicinity of the two props 28, 28' and in the area between the guide 15 and the front arm end 13 and between the guide 16 and the laying arm end 14.

Figure 4:
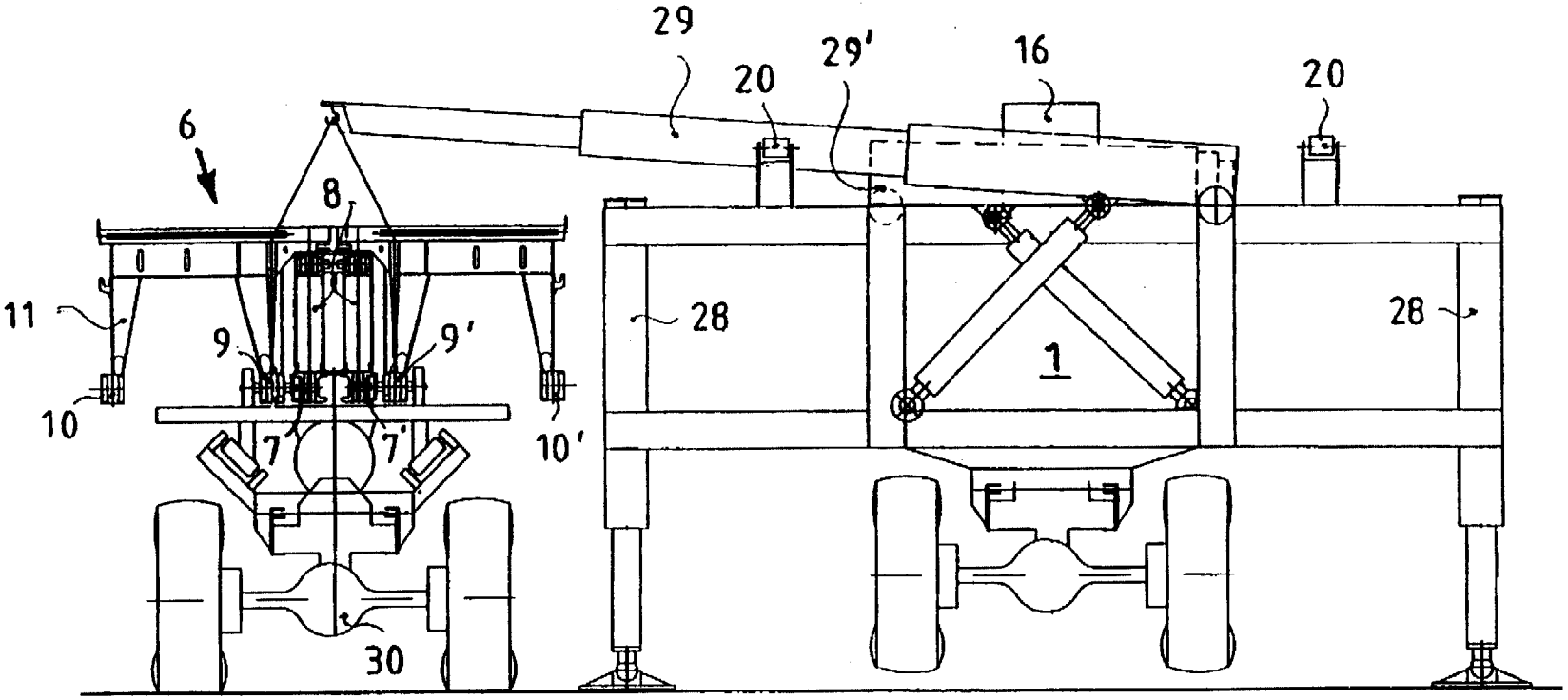
FIG. 4 is a cross section of the device in the area of the integrated hoist and a tracking vehicle with a bridge section in the state of transportation.

FIG. 4 shows a top view of the wheel vehicle (truck) with the device 1 in the area of the integrated hoist 29, 29' and next to it a tracking vehicle 30 with a bridge section 6 in the state of transportation. It can be clearly recognized how one hoist 29 is brought into position and the other 29' remains in the transportation position and thus it does not hinder the laying process. The hoist allows placement of a bridge section 6 on the displacing means 4, 4' or to remove same from the displacing means 4, 4'.

A drive 25 in the front arm 2 acts on the lower chord 7, 7' of the launching support 8. The supporting rollers 26, 26' are arranged at the front arm tip 27 under the lower chords 7, 7' of the launching support 8 and under the inner lower chords 9, 9' of the track support 11.

Figure 5:
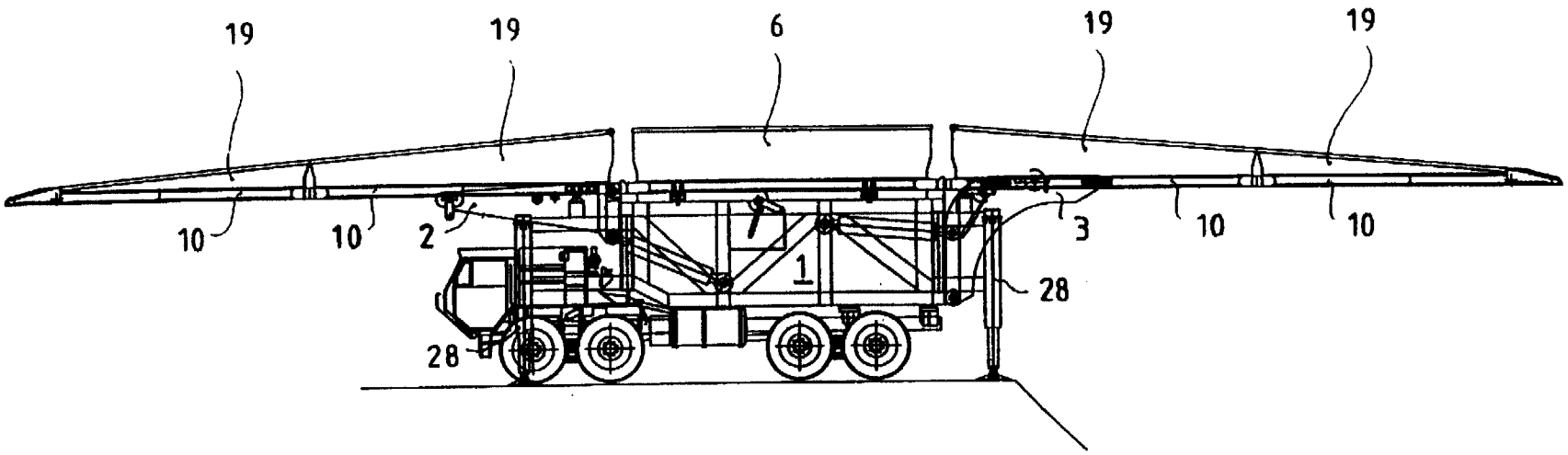
FIG. 5 is a side view of the device on the vehicle with the bridge sections deployed on the device.

FIG. 5 shows the various bridge sections 6 and 19 deployed on the device.

While a specific embodiment of the invention has been shown and described in detail to illustrate the application of the principles of the invention, it will be understood that the invention may be embodied otherwise without departing from such principles.

What is claimed is:

1. A device for assembling and laying track support bridge sections displaceable at right angles to their longitudinal axis, with launching support structures, which are arranged between the track supports axis are likewise transversely displaceable, into a bridge support structure, the device comprising:

a base frame with a plurality of telescoping and pivotable props, said base frame being built up on a vehicle;

a laying arm pivotable around a horizontal axis at one end of said base frame;

a front arm pivotable around a horizontal axis at another end of said base frame, both of said laying arm and said front arm being adjustable by means of hydraulic cylinders;

displacing means for pushing the bridge sections apart and together, the bridge sections including track support and launching support sections, said base frame forming a support, the track support and launching support sections being arrangable between said front arm and the said laying arm on said base frame in a transverse direction in relation to said base frame, said base frame supporting both each lower chord of said launching support section and each lower chord of said track support in a mounting manner;

a height-adjustable feed drive, for driving said launching support after one of said bridge sections has been pushed apart, said feed drive being arranged on said base frame between said front arm and said laying arm;

a front end guide for positioning one of said bridge sections, which is to be fitted in and can be pushed apart, said front end guide being arranged between said front arm and the said laying arm adjacent to said front arm end;

a laying arm end guide for positioning one of the bridge sections, which is to be fitted in and can be pushed apart, said laying arm end guide being arranged between said front arm and said laying arm adjacent to said laying arm end;

connection means for establishing a connection between the bridge sections fed in and pushed apart, and the bridge section or bridge sections already present on the device, said connection means being arranged in an area of said guides; and a mount provided for each of said telescoping and pivotable props, each mount for receiving said outer lower chords of the bridge sections moved apart.

2. A device in accordance with claim 1, wherein said displacing means includes horizontal bearing rollers with wheel flanges facing each other for receiving said lower chords of said launching support and additional horizontal outer bearing rollers for said outer lower chords of said track support with vertical guide rollers arranged adjacent thereto.

3. A device in accordance with claim 1, further comprising a drive in said front arm acting on said lower chord of said launching support, and supporting rollers arranged at a tip of said front arm under said lower chords of said launching support and under said inner lower chords of said track support.

4. A device in accordance with claim 1, further comprising a hoist arranged adjacent to two of said plurality of telescoping and pivotable props, between said front end guide and said front arm end and between said laying arm end guide and the said laying arm end in order to place a said bridge section on said displacing means for to remove said bridge section from the said displacing means.

5. A device for assembling and laying track support bridge sections displaceable at right angles to their longitudinal axis, with launching support structures, which are arranged between the track supports and are likewise transversely displaceable, into a bridge support structure, the device comprising:

a base frame with a plurality of telescoping and pivotable props, Raid base frame being built up on a vehicle;

a laying arm pivotable around a horizontal axis at one end of said base frame;

a front arm pivotable around a horizontal axis at another end of said base frame, both of said laying arm and said front arm being adjustable by means of hydraulic cylinders;

displacing means for pushing the bridge sections apart and together, the bridge sections being arrangable between said front arm and the said laying arm on said base frame in a transverse direction in relation to said base frame, said base frame supporting the bridge sections in a mounting manner;

a height-adjustable feed drive, for driving the launching support after one of the bridge sections has been pushed apart, said feed drive being arranged on said base frame between said front arm and said laying arm;

a front end guide for positioning one of the bridge sections, which is to be fitted in and can be pushed apart, said front end guide being arranged between said front arm and the said laying arm adjacent to said from arm end;

a laying arm end guide for positioning one of the bridge sections, which is to be fitted in and can be pushed apart, said laying arm end guide being arranged between said front arm and the said laying arm adjacent to said laying arm end;

connection means for establishing a connection between the bridge sections fed in and pushed apart, and the bridge section or bridge sections already present on the device, said connection means being arranged in an area of said guides; and a mount provided for each of said telescoping and pivotable props, each mount for receiving outer lower chords of the bridge sections moved apart.

6. A device in accordance with claim 5, wherein said displacing means includes horizontal bearing rollers with wheel flanges facing each other for receiving said lower chords of said launching support and additional horizontal outer bearing rollers for said outer lower chords of said track support with vertical guide rollers arranged adjacent thereto.

7. A device in accordance with claim 5, further comprising a drive in said from arm acting on said lower chord of said launching support, and supporting rollers arranged at a tip of said front arm under said lower chords of said launching support and under said inner lower chords of said track support.

8. A device in accordance with claim 5, further comprising a hoist arranged adjacent to two of said plurality of telescoping and pivotable props, between said front end guide and said front arm end and between said laying arm end guide and the said laying arm end in order to place a said bridge section on said displacing means or to remove said bridge section from the said displacing means.

* * * * *